United States Patent [19]

Warshawsky

[11] 4,347,557

[45] Aug. 31, 1982

[54] SWIVEL JOINT

[75] Inventor: Jerome Warshawsky, Baldwin Harbor, N.Y.

[73] Assignee: I. W. Industries, Inc., Melville, N.Y.

[21] Appl. No.: 182,786

[22] Filed: Aug. 29, 1980

Related U.S. Application Data

[62] Division of Ser. No. 28,102, Apr. 9, 1979, Pat. No. 4,247,886.

[51] Int. Cl.[3] ..... F21M 3/18

[52] U.S. Cl. ..... 362/427; 362/431; 362/432; 403/164

[58] Field of Search ..... 362/427, 431, 432; 403/164

[56] References Cited

U.S. PATENT DOCUMENTS 4,247,886 1/1981 Warshawsky ..... 362/431

*Primary Examiner*—Stephen J. Lechert, Jr.

*Attorney, Agent, or Firm*—Stephen E. Feldman; Marvin Feldman; Jules L. Chaboty

[57] ABSTRACT

A swivel joint assembly comprises a first arm member having a first end joint on one end. The end joint has an arcuate groove thereon. A second arm member has a second end joint on one end. The second joint has stop structure thereon for limiting rotational movement of said swivel joint to approximately 360°. A swivel structure provides rotational movement between the first and second end joints. The swivel structure includes a fastener for securing the first and second end joints to each other. The stop element protrudes into the arcuate groove and a stop shoulder on the arcuate groove coacts with the stop element to limit rotational movement of the swivel joint.

14 Claims, 5 Drawing Figures

FIG. 3
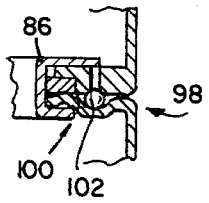
FIG. 4
FIG. 5
FIG. 1
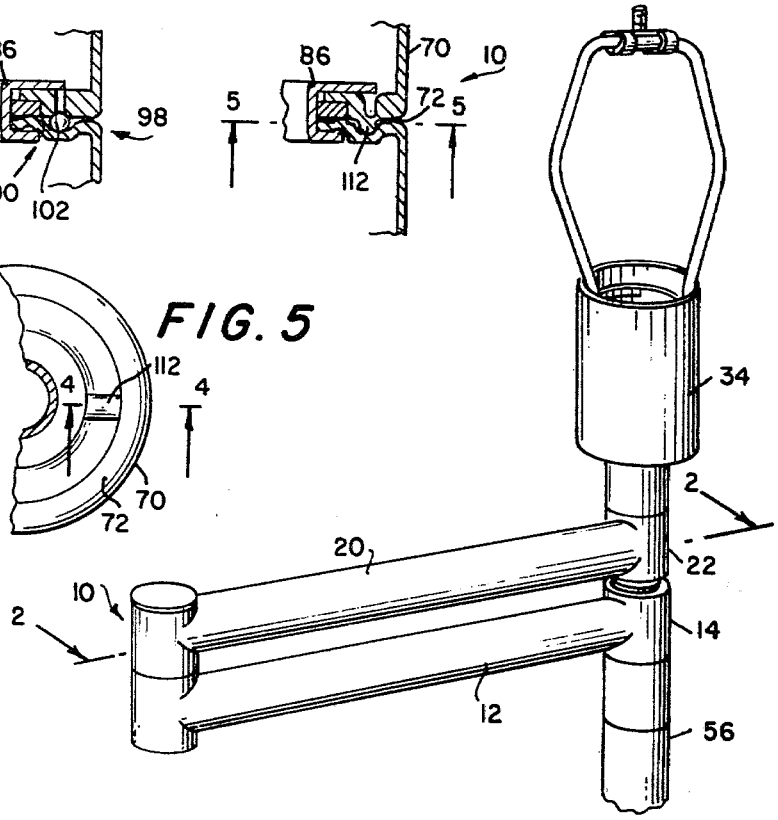
FIG. 2
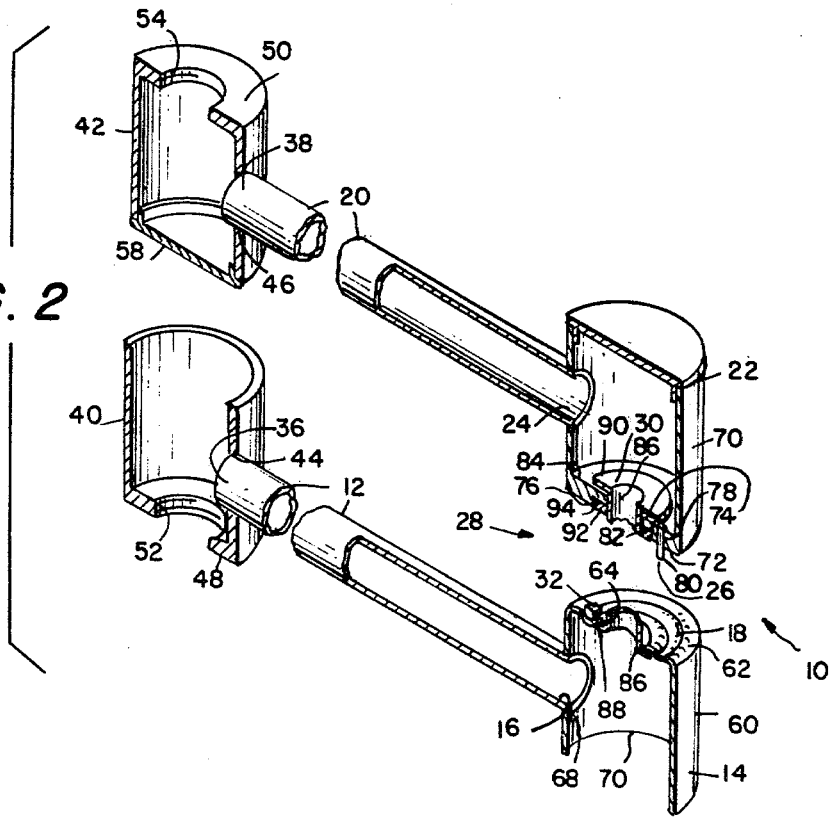

SWIVEL JOINT

This is a division of application Ser. No. 28,102 filed 04/09/79, now U.S. Pat. No. 4,247,886.

BACKGROUND OF THE INVENTION

While the invention is subject to a wide range of applications, it is especially suited for use with an electrical fixture and will be particularly described in that connection.

In the past, various types of swivel joints have been provided in a number of different types of applications. In the area of light fixtures, it is important to be able to move a light fixture and thereby change the intensity and orientation of a light source to minimize eye strain. Since electrical wiring is required in such an application, it is important that the rotation of the swivel joint is limited in order to prevent unlimited swivel action which might cause failure of the wire associated with the light.

The prior art shows swivel joints which either did not provide for a large degree of rotation or the structure was relatively complex and expensive to manufacture.

U.S. Pat. No. 4,121,280 to Chapman, et al, discloses, for example, "A wall mountable light fixture with a dimmer for controlling liminescence and having a plurality of articulated arms that are movable between a retracted position adjacent the wall and an extended position outwardly of the wall". Two races 156 and 158, as best seen in FIG. 6, are disposed in congruent arcuate paths that are coaxial with the rotational axis of the swivel joint. A ball member 162 is provided between the two races and permits relative rotation of 360°. Thus, two races are required to provide the desired amount of rotation of the swivel joint.

U.S. Pat. No. 2,644,660 to Dudley, illustrates a device for supporting a tray which had a swivel joint having pins extending into a short arcuate groove 36 to provide limited rotation of the joint.

It is an object of the present invention to provide a swivel joint which substantially obviates one or more of the limitations and disadvantages of the described prior arrangement.

It is a further object of the present invention to provide a simplified swivel joint which can rotate approximately 360°.

It is further object of the present invention to provide a simplified swivel joint which is relatively inexpensive to manufacture.

SUMMARY OF THE INVENTION

Accordingly, there has been provided a swivel joint assembly comprising a first arm member having a first end joint on one end. The end joint has an arcuate groove thereon. A second arm member has a second end joint on one end. The second joint has stop structure thereon for limiting rotational movement of said swivel joint to approximately 360°. A swivel structure provides rotational movement between the first and second end joints. The swivel structure includes a fastener for securing the first and second end joints to each other. The stop element protrudes into the arcuate groove and a stop shoulder on the arcuate groove coacts with the stop element to limit rotational movement of the swivel joint.

For a better understanding of the present invention, together with other and further objects thereof, reference is had to the following description, taken in connection with the accompanying drawings, while its scope will be pointed out in the appended claims.

BRIEF DESCRIPTION OF THE DRAWINGS

FIG. 1 is a perspective view of a light fixture embodying the invention;

FIG. 2 is a perspective view, partly in cross-section of the swivel joint assembly;

FIG. 3 is a sectional view showing a second embodiment of the present invention; and FIG. 4 is a sectional view showing the third embodiment of the present invention.

DESCRIPTION OF THE PREFERRED EMBODIMENTS

A swivel joint assembly 10 has a first arm member 12 having a first end joint 14 on one end 16. The first end joint has an arcuate groove 18 thereon. A second arm member 20 has a second end joint 22 on one end 24. The second end joint 22 has a stop mechanism 26 thereon for limiting rotational movement of the swivel joint 10 to approximately 360°. A swivel structure 28 provides rotational movement between the first and second end joints and includes a fastener 30 to secure the first and second end joints to each other, whereby the stop mechanism 26 protrudes into the arcuate groove 18. A stop shoulder 32 is provided in the arcuate groove and co-acts with the stop mechanism to limit rotational movement of the swivel joint.

Referring to FIGS. 1 and 2, there is illustrated a swivel joint assembly 10 which may be used in conjunction with a light fixture 34. Two arm members 12 and 20 have first ends 16 and 24 and second ends 36 and 38, respectively. The arm members are preferably hollow and may be formed of any desirable material such as for example aluminum, plastic, or steel. Connecting tubular elements 40 and 42 are affixed to arm members 12 and 20, respectively, as seen in FIG. 2. These connecting tubular elements are substantially identical and include apertures 44 and 46 in the side wall for receiving the arm members. The arm members may be fastened to the tubular elements with any desired techniques, such as for example, welding. One end 48 and 50 of each of the tubular elements may include a threaded bore 52 and 54 for connection to any desired structure, such as for example, a base column 56 and a light fixture 34, respectively. Also, a closure disc 58 may be provided in the open end of the connecting tubular elements 40 to eliminate disposure of any wiring passing through the tubular elements and to prevent dirt from entering therein.

It is further within the scope of the present invention to provide swivel joints to replace the connecting tubular elements for any other type of connecting element as desired.

An end joint 14 may be affixed to the end 16 of the arm member 12. The end joint may be formed of a tubular element 60 having an end surface 62, with an aperture 64 located therein. An arcuate groove 66 is adjacent to the aperture, as best seen in FIG. 2. A relatively narrow stop shoulder 32 is provided in the arcuate groove and may extend to the end surface 62. The tubular element 60 includes and aperture 68 for receiving the arm member 12. The latter may be attached to the tubular element in any desired manner, such as for example, welding. A closure disc (not shown) substantially identical to the closure disc 58, may be provided in the open end 70 of the tubular element. The tubular element may be easily formed by any desired manufacturing technique, such as for example, stamping.

A second end joint 22 may be formed of a tubular element 70 having an end surface 72 with an aperture 74 centrally located therein. A circular groove 76 is provided adjacent aperture 74 on the end surface 72.

A stop structure 26 includes an aperture 78 through the end surface 72 and adjacent the circular groove 76. A projecting element 80 is affixed in the aperture 78, as will be further described. The projecting element may be a pin having a head 82 resting against an inner surface 84 of the end surface 72. The projecting element protrudes beyond the end surface 72 and rides in the arcuate groove 18, as will be further described.

A swivel structure 28 for providing rotational movement between the end joints 14 and 22 includes a fastener 30. The fastener 30 may be comprised of a hollow pin 86 which extends through the apertures 64 and 74 when the end joints 14 and 22 are swivelly connected to each other. The pin 86 includes flared sections 88 and 90 on either end to bare against the inner surfaces of the end surfaces 62 and 72, respectively. It should be noted that the flared section 90 rests on the head 82 of the projecting element 80 and thereby affixes the projecting element in the aperture 78.

A circular washer 92 is provided in the circular groove 76 and has a width so as to protrude beyond the end surface 72 of the tubular element 70. The washer 92 has a surface 94 which contacts the end surface 62 of the tubular element 60 adjacent the aperture 64. The washer allows for smooth rotational movement between the tubular elements as will be described. The washer may be formed of any desirable material, such as for example teflon or nylon.

To more fully understand the present invention, the assembly end operation is described below.

A projecting element 80 is inserted into an aperture 78 and a washer is placed in the circular groove 76 of the tubular element 70. Then the tubular element 62 is placed against the tubular element 70, so that the end surfaces 62 and 72 face each other. The hollow pin 86 is inserted in the aperture 64 and 74 and flared out at each end in order to secure the first and second end joints to each other with the projecting element 80 protruding into the arcuate groove 18. It can readily be seen that the stop mechanism 26 limits rotational movement of the swivel joint to approximately 360° due to the projecting element 80 co-acting with the stop shoulder 32. Since the stop shoulder 32 is a very thin wall, it allows the swivel joint to have barely a full 360° rotation. Any wiring which may be desired may extend through the hollow swivel joint assembly and through the arm members 12 and 20 and finally out of the connecting tubular elements 40 and 42. Finally, closure discs, such as the type illustrated as 58, may be placed on the open end surfaces of each of the tubular elements 40, 42, 60 and 70 as desired. Then, a light fixture 34 may be affixed to the tubular element 42 and a base colume 56 may be attached to the tubular element 40, or vice-a-versa, as desired. In addition, additional swivel joint assemblies may replace the connecting tubular elements 40 and/or 42 as desired.

A second embodiment of the present invention is illustrated in FIG. 3. The invention resides in the stop mechanism 100. A spherical ball member 102, having a diameter slightly greater than the aperture 78, is placed between the aperture and the arcuate groove 18. All of the remaining structure of the swivel joint is substantially similar to the swivel joint assembly 10. When the swivel joint 98 is assembled with the pin 86, the spherical ball 102 is held in the aperture due to the pressure exerted by the arcuate groove 18. When the tubular elements 60 and 70 are rotated with respect to one another, the ball moves in the arcuate groove until it is stopped by the stop shoulder 32. The spherical ball may be formed of any desirable material, such as for example steel or teflon.

Referring to FIG. 4, a third embodiment of the present invention is illustrated. A stop mechanism 110 is a protuberance which extends from the end surface 72 of the tubular element 70. The protuberance may be formed of a unitary piece of material which is a part of the tubular element 70. Also, the protuberance may have a curved end which engages the arcuate groove 18. The protuberance 112 may be formed by stamping the tubular element 70. The result is that the sides of the protuberance 112 are substantially flat and extend perpendicularly from the end surface 72, as best seen in FIG. 5. It is within the scope of the present invention to form this protuberance in any desired shape, such as, for example, a hemisphere.

It can thus be understand to one skilled in the art that a swivel joint has been provided that provides approximately 360° rotation. Also, the swivel joint has a single arcuate groove and may have a simple noncomplex design which is relatively inexpensive to manufacture.

While there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention:

I claim:

1. A swivel joint assembly comprising:

a. a first tubular arm member having a first end joint on one end and a connecting tubular element on the other end, said first end joint having an arcuate groove thereon;

b. a second tubular arm member having a second end joint on one end and a connecting tubular element on the other end substantially identical to said connecting tubular element on said first tubular arm, said second end joint having stop means thereon for limiting rotational movement of said swivel joint to approximately 360°; and c. a base, connected to said connecting tubular element of said first tubular arm member; and d. a light fixture connected to said connecting tubular element of said second tubular arm member; and e. swivel means for providing rotational movement between said first and second end joints, including fastener means for securing said first and second end joints to each other, whereby said stop means protrudes into said arcuate groove and a stop shoulder on said arcuate groove co-acting with said stop means to limit rotational movement of said swivel joint.

2. The swivel joint assembly, as defind in claim 1 further characterized in that said stop means is a protuberance extending from said second end joint.

3. The swivel joint assembly, as defined in claim 2, further characterized in that said second protuberance and said second end joints are formed of a unitary piece of material.

4. The swivel joint assembly, as defined in claim 3, further characterized in that said protuberance has a curved end.

5. The swivel joint assembly, as defined in claim 4, further characterized in that said stop means includes an aperture in said second joint and a projecting element affixed in said aperture and protruding into said arcuate groove.

6. The swivel joint assembly, as defined in claim 5, further characterized in that said projecting element is a cylindrical pin.

7. The swivel joint assembly, as defined in claim 6, further characterized in that said projecting element is a spherical member.

8. The swivel joint assembly, as defined in claim 7, further characterized in that said first end joint is a first tubular element having an end surface with a second aperture centrally located therein and said arcuate groove being adjacent to said aperture.

9. The swivel joint assembly, as defined in claim 8, further characterized in that said second end joint is a second tubular element having an end surface with a third aperture centrally located therein and said stop means being adjacent to said aperture.

10. The swivel joint assembly, as defined in claim 6, further characterized in that said fastener means is a pin which extends through said second and third aperture and has a flared section on either end to bare against the inner end surfaces of said first and second tubular element.

11. The swivel joint assembly, as defined in claim 10, further characterized in that said pin is a hollow element.

12. The swivel joint assembly, as defined in claim 11, further characterized in that said stop shoulder is a thin wall extending across said arcuate groove.

13. The swivel joint assembly, as defined in claim 12, further characterized in that washer means are provided between said first and second tubular elements for allowing smooth rotational movement between said tubular elements.

14. The swivel joint assembly, as defined in claim 13, further characterized in that said first and second tubular element each have an open end opposite their respective end surface, first and second cover elements are affixed to said first and second tubular elements to close said open end.

* * * * *